US005385232A

United States Patent [19]

Foos et al.

[11] Patent Number: 5,385,232

[45] Date of Patent: Jan. 31, 1995

[54] PACKAGING FOR FRAGILE ARTICLES HAVING CONTROLLED COLLAPSIBILITY

[75] Inventors: Douglas E. Foos, Barrington Hills, Ill.; Fred Schindler, Santa Cruz, Calif.

[73] Assignee: Plastofilm Industries Inc., Wheaton, Ill.

[21] Appl. No.: 185,491

[22] Filed: Jan. 24, 1994

[51] Int. Cl.[6] ..... B65D 81/02

[52] U.S. Cl. ..... 206/320

[58] Field of Search ..... 206/521, 586, 591, 592, 206/594, 583, 486, 320

[56] References Cited

U.S. PATENT DOCUMENTS

| | | | |
|---|---|---|---|
| 2,783,930 | 3/1957 | Riley . | |
| 2,935,206 | 5/1960 | Smith . | |
| 2,974,788 | 3/1961 | Robbins . | |
| 2,994,466 | 8/1961 | Thompson . | |
| 3,176,743 | 4/1965 | Bundy . | |
| 3,181,766 | 5/1965 | Kane et al. . | |
| 3,366,231 | 1/1968 | Trakas . | |
| 3,437,423 | 4/1969 | Mondiadis . | |
| 3,724,654 | 4/1973 | Gerard et al. . | |
| 3,768,639 | 10/1973 | Dogliotti . | |
| 3,835,986 | 9/1974 | Le Beau . | |
| 4,006,818 | 2/1977 | Wannyn . | |
| 4,132,311 | 1/1979 | Glinert . | |
| 4,398,212 | 8/1983 | Serry et al. . | |
| 4,407,898 | 10/1983 | Kato et al. | 206/586 X |
| 4,645,079 | 2/1987 | Hill . | |
| 4,671,407 | 6/1987 | Brutosky . | |
| 4,709,808 | 12/1987 | Balduff et al. . | |
| 4,823,956 | 4/1989 | Belisle . | |
| 4,883,179 | 11/1989 | Dionne . | |
| 4,972,951 | 11/1990 | Vartanian . | |
| 5,056,665 | 10/1991 | Boecher et al. | 206/583 |
| 5,226,543 | 8/1993 | Foos et al. . | |

FOREIGN PATENT DOCUMENTS

| | | |
|---|---|---|
| 3843990 | 7/1990 | Germany . |
| 1224493 | 3/1971 | United Kingdom . |
| 2229416 | 9/1990 | United Kingdom . |

OTHER PUBLICATIONS

A drawing illustrating a U-Pad & Lid for packaging fragile articles.

*Primary Examiner*—Jacob K. Ackun, Jr.
*Attorney, Agent, or Firm*—Welsh & Katz, Ltd.

[57] ABSTRACT

A unitary packaging structure for a shock sensitive article, including a platform portion adapted to support the article and having a peripheral portion, a sidewall structure forming an enclosure around the platform portion, the sidewall structure including an inner wall being joined to the peripheral portion, and an outer wall peripherally spaced from the inner wall, the inner wall being relatively shorter than the outer wall so that the platform portion is held a specified cushion distance above a lower edge of the outer wall, and at least one collapsibility control device for selectively releasing air compressed beneath the package when the package is subjected to shock loading while disposed in a shipping container, the control device controlling the collapsibility of the package.

23 Claims, 5 Drawing Sheets

PACKAGING FOR FRAGILE ARTICLES HAVING CONTROLLED COLLAPSIBILITY

DESCRIPTION

1. Technical Field

The present invention relates to packaging for fragile structures such as computer monitors, microwave ovens, television sets or the like. More particularly, the invention relates to a flexible, thermally formed type of plastic packaging, of unitary construction, which is adapted to hold such fragile articles and to dissipate forces exerted upon shipping cartons containing such articles in such a manner that the articles are not damaged if the carton is dropped or mishandled.

2. Background of the Invention

Currently, the shipment of fragile articles, regardless of size and weight, requires special packaging to avoid damage to the articles. For this purpose, materials such as crumpled paper, nuggets of expanded foam, and/or preformed expanded polystyrene foam is used to package fragile articles, including but not limited to electronic articles such as computer monitors, radios, television sets, computer CPUs, computer disk drives microwave ovens, disk drives, VCR's and the like. The preformed polystyrene foam material is often provided in the form of "corners" or other support pieces which envelop at least portions of the packaged fragile article.

Aside from being bulky, upon an initial impact, the polystyrene foam loses virtually all of its shock absorbing qualities. Thus, fragile articles packaged with rigid pieces of expanded polystyrene foam as the protective media are susceptible to damage from repeated shocks to the box or container. A related disadvantage of such foam packaging is that a relatively thick piece of foam must be employed to protect a packaged article from impact, even though only a portion of the foam will be compressed upon impact.

Another disadvantage of conventional polystyrene foam is that its bulkiness requires packagers to allot significant warehouse storage space to the foam packaging elements prior to use. Also, shippers are required to select shipping containers, such as corrugated boxes, which are substantially larger than the article being packaged, merely to accommodate sufficient thicknesses of polystyrene foam which can absorb only one impact. Larger containers require additional warehouse space, both before and after assembly, and also take up more space per article shipped in rail cars or trailers.

Yet another disadvantage of conventional packaging for fragile articles is that because of its bulkiness, it is not generally economically feasible to ship the expanded polystyrene foam to a recycling location. Furthermore, even when the expanded polystyrene foam is recycled into product, the cost of recycling is relatively large and, generally, no more than about 25% recycled content can be utilized, with the remainder being virgin material. Indeed, considering the great quantity of expanded polystyrene foam which is currently in use to provide fragility packaging and the general lack of adequate recycling of this material, the adverse environmental impact is of staggering proportions. The present invention is directed to overcoming one or more of the above-identified problems.

Commonly-assigned U.S. Pat. No. 5,226,543 discloses a package for fragile articles which addresses the above-listed problems, and provides a solution in the form of a unitary package having a platform portion held a specified distance above the substrate by a peripheral wall formation which also borders the platform portion. Shock limiting formations are formed in the sidewall structure for restricting the movement of the platform portion toward the lower edge of the peripheral wall upon shock loading of the platform.

In use, it has been found that when packaged articles are relatively lightweight, the above-identified shock limiting package may be too rigid or stiff. As such, the platform portion may not move a significant amount toward the peripheral wall upon shock loading, and the shock forces are absorbed by the packaged article instead of by the package.

It has also been found that for some applications, the amount of preferred thermoformable material required for manufacturing the package is excessive, and results in an uneconomical solution to the above-identified packaging problem.

Accordingly, it is an object of the present invention to provide a unitary shock-resistant package for fragile articles which deforms to absorb shock loading even when the packaged article is relatively lightweight.

Another object of the present invention is to provide a shock-resistant package for fragile articles in which the deformability of the package is adjustable to suit the particular packaged article.

A still further object of the present invention is to provide a unitary shock-resistant package which economically employs thermoformable material while achieving the above-listed objects.

SUMMARY OF THE INVENTION

The above-identified objects are met or exceeded by the present package for fragile articles, including a platform or tray bounded at least in part by a peripheral wall structure including an outer wall, a relatively shorter inner wall, and a bridge section connecting the outer wall to the inner wall. The platform is integral with the inner wall so that when the package is placed in a carton, the outer wall contacts one of the carton surfaces, thus suspending the platform away from that surface. In addition, the package includes at least one collapsibility opening disposed in a specified location for releasing air trapped beneath the platform during a shock incident. The collapsibility of the package is thus controlled by the number and size of the openings, which regulate the release of air compressed by shock loading.

More specifically, the present unitary packaging structure for a shock sensitive article includes a platform portion adapted to support at least a portion of the article and having a peripheral portion, a sidewall structure forming an enclosure around at least a portion of the platform portion, the sidewall structure including an inner wall adjacent the peripheral portion, and an outer wall peripherally spaced from the inner wall. The inner wall is relatively shorter than the outer wall so that the platform portion is held a specified cushion distance above a lower edge of the outer wall.

In addition, at least one collapsibility control device is included for selectively releasing air compressed beneath the package when the package is subjected to shock loading while disposed in a shipping container. The control device is constructed and arranged on the package to control the collapsibility of the package. In the preferred embodiment, the control device takes the form of at least one collapsibility opening located in at least one of the platform portion and the sidewall structure.

An advantage of the present invention is that the collapsibility of the package may be adjusted merely by altering the number and placement of openings on a basic package. Thus, one basic package design may be employed for shipping a wide variety of different products, each having a particular weight.

Another advantage of the present invention is that modifications to the collapsibility may be easily made in the field without extensive tooling changes.

In another embodiment, a packaging structure for a shock sensitive article is provided which includes a platform portion adapted to support at least a portion of the article. The package structure has a peripheral portion with a first edge and a second edge, with a sidewall structure forming an enclosure around the first edge. Included in the sidewall structure is an inner wall which is integral with the peripheral portion, and an outer wall peripherally spaced from the inner wall. The inner wall is relatively shorter than the outer wall so that the platform portion is held a specified distance above a lower edge of the outer wall. In addition, a shock limiting device is formed in the sidewall structure for restricting the movement of the platform portion toward the lower edge of the outer wall upon shock loading of the platform portion, and a support structure is provided for supporting the second edge of the platform against vertical displacement. If desired, a plurality of such structures may be disposed on a substrate for supporting various portions of a fragile article.

DESCRIPTION OF THE PREFERRED EMBODIMENT

Figure 1:
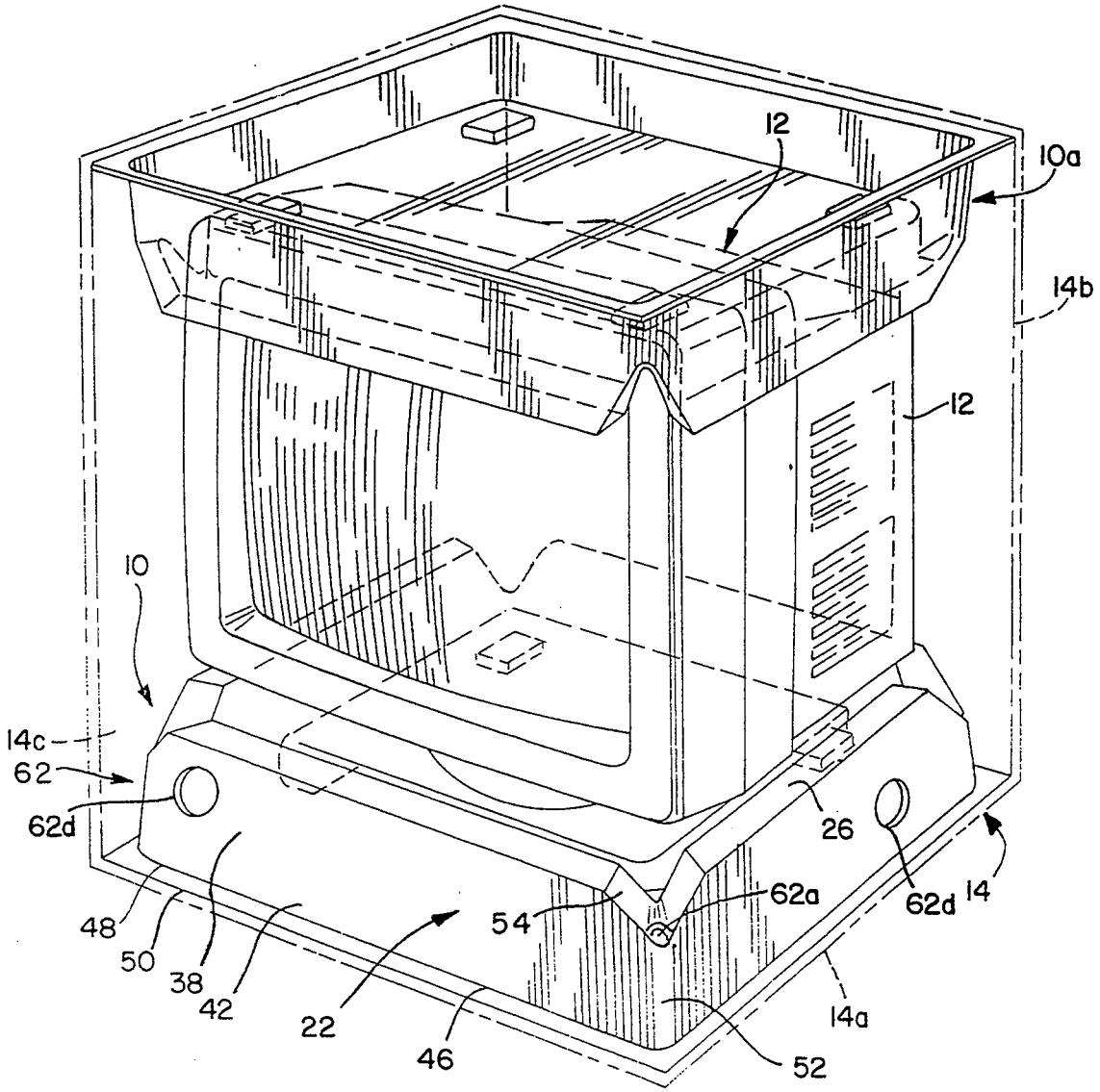
FIG. 1 illustrates, in a top perspective view, a computer monitor located in an enclosure in a form of packaging in accordance with an embodiment of the invention, and also having a package of the invention positioned on a top surface of the monitor.

The preferred embodiment of the present invention provides a unitary packaging structure 10 as shown in FIGS. 1, 2 and 4–6. An alternate embodiment is shown in FIG. 3 and is generally designated 110. Components and features which are shared by the structures 10 and 110 have been designated with identical reference numerals. As illustrated in FIG. 1, the unitary packaging structure 10, 110 is adapted to hold a shock sensitive article 12 such as the computer monitor shown in the figure. The packaging structure 10,110, along with the article 12, will normally be positioned within a container 14, such as a box or corrugated carton. The bottom 14*a* and two walls 14*b*, 14*c* of the container 14 are shown in phantom in FIG. 1, in a relatively tight fitting arrangement about the article 12 and the packaging structure 10. Furthermore, another one of the unitary packaging structures 10, 110 is shown at 10*a* placed atop the sensitive article 12 to sandwich the article between two such packaging structures 10, 110 within the container 14.

Figure 2:
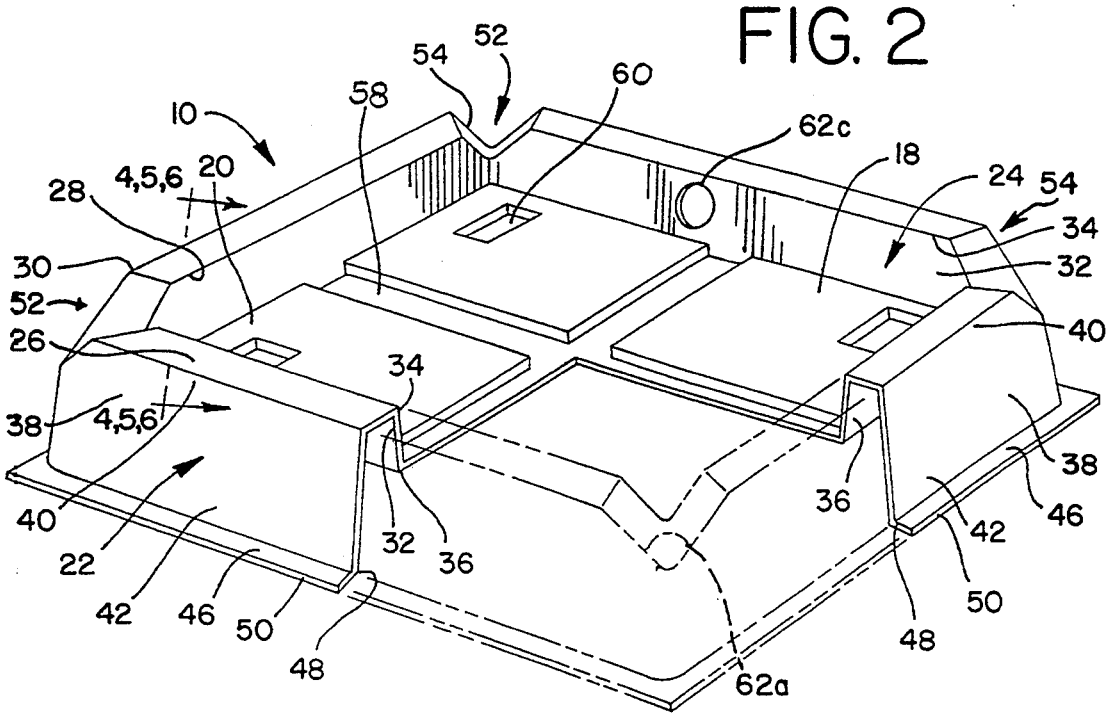
FIG. 2 illustrates, in a perspective view of the present packaging structure taken similar to the view of FIG. 1 with portions shown cut away.
Figure 3:
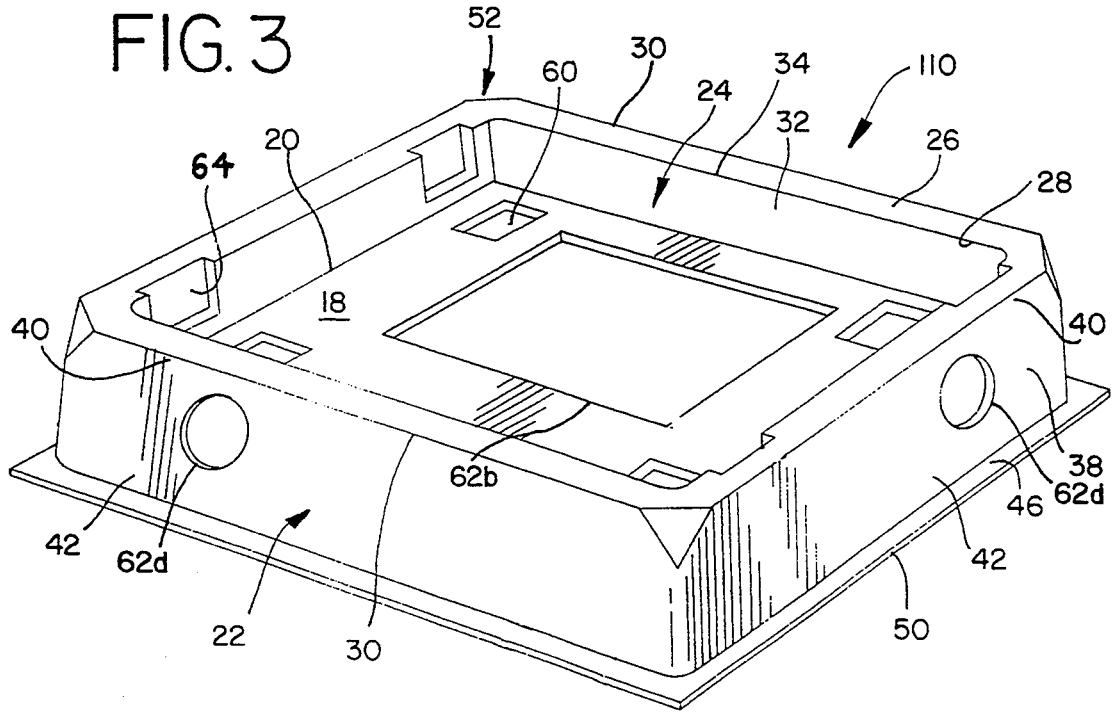
FIG. 3 illustrates, in a view similar to FIG. 2 but without any portion cut away, an alternate embodiment in accordance with the present invention.

Referring to FIGS. 1 and 2, it will be seen that the unitary packaging structure 10 is in the general form of a tray having a platform portion 18 which is adapted to support the shock sensitive article 12. The platform portion 18 has a peripheral portion 20 which is attached to a sidewall structure 22 forming part of the tray. The sidewall structure 22 forms at least a partial enclosure 24 which, in the preferred embodiment, when viewed from above or below, is in the shape of a polygon, or of an arcuate structure such as a circle, oval or ellipse.

Figure 2A:
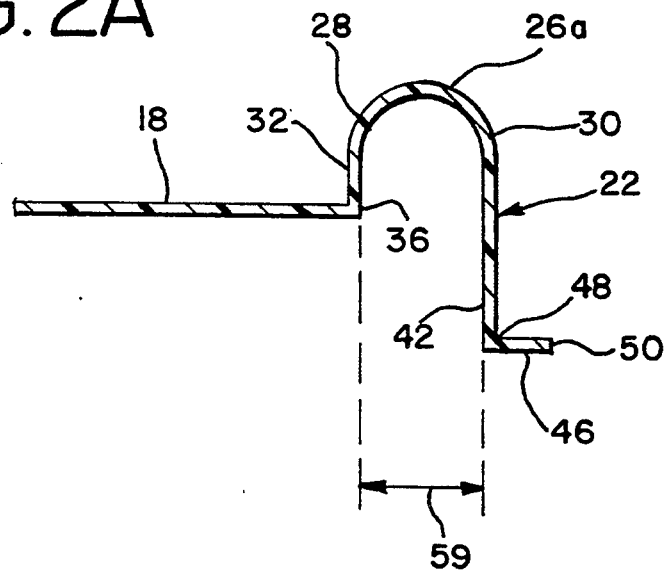
FIG. 2A is a fragmentary sectional view of an alternate embodiment to the packaging structure of FIG. 2.

The sidewall structure 22 has a transverse bridge section 26 which has an inner edge portion 28 and an outer edge portion 30. The bridge section 26 may be a generally flat, horizontal member, as shown in FIGS. 1, 2 and 3, but may also be provided in other shapes, including curved as shown at 26*a* in FIG. 2A, or pointed cross-sections (not shown).

A relatively shorter, inner wall 32 has a proximal end 34 which is integral with the inner end portion 28 of the bridge section 26 and has a distal end 36 which extends in a direction away from the bridge section 26. The sidewall structure 22 also has a relatively longer, outer wall 38 with a proximal end 40 which is integral with the outer end portion 30 of the bridge section 26. The relatively longer outer wall 38 has a distal or lower end 42 which extends in a direction away from the bridge section 26.

The peripheral portion 20 of the platform portion 18 is integral with the distal end portion 36 of the shorter wall 32 such that the platform portion 18 of the platform portion 18 is supported by the sidewall structure 22. In other words, the platform portion 18 is held in suspended relationship above a lower end 42 of the longer wall 38 by the sidewall structure 22. The distance between the platform portion 18 and the lower edge of the lower end 42 will be referred to as the cushion thickness 58 (best seen in FIG. 4).

It will be noted that the base of the shock sensitive article 12 is in a relatively tight fit against the shorter wall 32 of the sidewall structure 22. Indeed, for better shock protection it is preferred that the shorter wall 32 is adapted to pressingly engage the article 12 when the article 12 is positioned on the platform portion 18 (best seen in FIG. 1).

The sidewall structure 22 can include a foot structure 46 which has an inner peripheral edge 48 and an outer peripheral edge 50. The foot structure 46 extends along the lower end 42 of the longer wall section 38. The outer edge 50 of the foot structure 46 extends outwardly from the lower end 42 of the longer wall 38. Generally, the foot structure 46 will be made integrally with the lower end 42 of the longer wall 38. It is preferable that the foot structure 46 flare outwardly from the lower end 42 of the longer wall 38 at such an angle that when the foot structure 46 is positioned against a flat surface, for example, against the bottom 14*a* of the container 14, the outer edge 50 of the foot structure 46, which is in contact with the container walls 14*b*, 14*c*, will make an acute angle with the flat surface. This allows additional flexure at the joinder of the lower end 42 of the longer wall 38 with the foot structure 46, whereby forces exerted in the direction shown by the arrow 44 (best seen in FIG. 5) can be more adequately dissipated without harm to the shock sensitive article 12.

At least one corner 52 is provided to the sidewall structure 22 when the structure is of polygonal shape as shown in the preferred embodiment in FIG. 2, each corner defining a pair of wall segments from adjacent portions of the sidewall structure. Thus, in a quadrilateral packaging structure 10,110, the four corners 52 will define four wall segments, each segment including a portion of the shorter wall 32, a portion of the longer wall 38, and a portion of the bridge section 26.

To allow shocks to be dissipated through the packaging structure 10, 110, the structure is formed of a flexible, preferably polymeric, material to allow shocks to be dissipated primarily via flexing of the walls 32 and 38 which, after such flexing, elastically return to their original shape. An advantage of this property is that the present packaging structure 10, 110 may absorb repeated shock impacts without deteriorating. Any of a number of polymeric materials can be utilized to form the unitary packaging structure 10, 110. Generally, such materials will be characterized by the physical properties of durability, elasticity or "memory", high and low temperature stability, and thermoformability.

Particularly useful for forming the unitary packaging structure 10, 110 of the present invention is high density polyethylene (HDPE), although other polymeric materials may be equally suitable, depending on the application. High density polyethylene generally has a stiffness of about 150,000 psi. This provides sufficient flexibility for the purposes of the present invention and sufficient elasticity so that the packaging structure 10, 110 will return to its original loaded or less stressed state following absorption of a shock. If desired, the HDPE used in making the packaging structure 10 may be recycled, post-consumer material.

The sheets of polymeric material which are thermoformed into the packaging structure 10,110 will generally be from about 10 to about 90 gauge (mils) in thickness. In addition to thermoforming, it is contemplated that the present packaging structure 10, 110 may also be produced by injection molding. Regardless of the method of manufacture, the particular thickness of the polymeric material making up the sidewall structure 22 and the platform portion 18 will be a function of the specific properties of the polymeric material itself, and the weight and shape of the shock sensitive article 12 which is to be supported by the particular packaging structure 10, 110. Generally, the packaging structure 10, 110 of the present invention can be designed to provide sufficient protection for the packaged article 12 to provide protection as low as the 20*g* level under all ambient weather conditions.

Referring now to FIG. 1, if an article 12 is positioned upon a unitary packaging structure 10, another such structure 10*a* is placed atop the article 10, and the combination of the packaging structure and shock sensitive article is placed in the container 14, a typical shipping arrangement will result. If this arrangement is shocked, as by dropping it, there will be a resultant force downwardly upon the platform portion 18 of the platform portion 18 as shown by the dashed arrow 44 in FIGS. 5 and 6.

In response to the force represented by the arrow the platform portion 18 will be drawn downwardly, thus exerting a downward force upon the shorter wall 32 as well as the bridge 26. This action will exert a flexing, downwardly directed force upon the longer wall 22 which will cause it to bow out to some extent, usually to the point where the bowed longer wall will contact an inside surface of the container 14.

Through this flexing action, the downward force illustrated by the arrow 44 exerted upon the platform 18 is dissipated into a lateral force by the sidewall structure 22. More specifically, this force is taken up in flexure of the walls 32 and 38, and the bridge section 26. Ideally, the flexure of the sidewall structure 22 will permit the platform 18 to descend into the cushion distance 58 up to a maximum extent which is less than or equal to the lower end 42 of the longer wall 38. In the preferred embodiment, the platform 18 is designed to descend approximately 90% of the cushion distance under maximum shock load.

Figure 4:
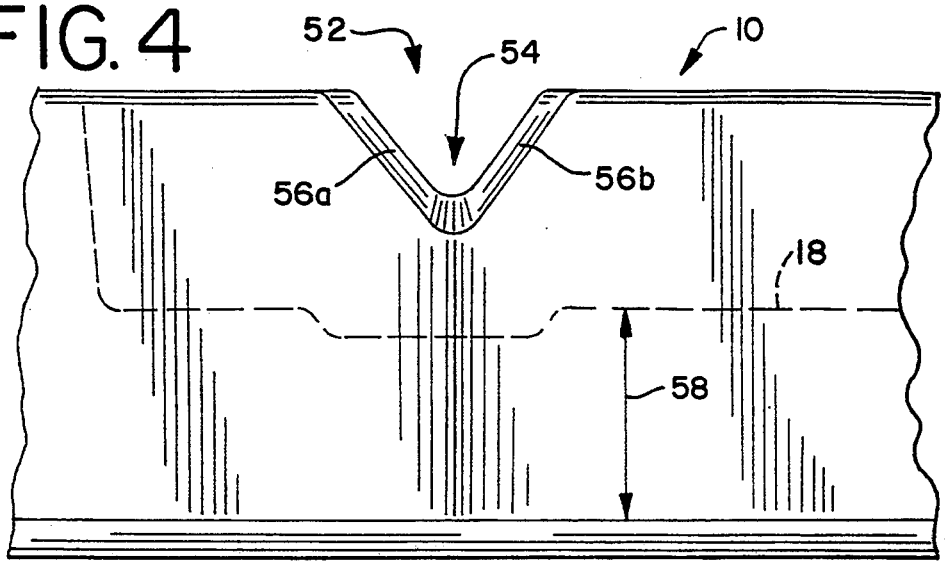
FIG. 4 illustrates a view taken along the line 4—4 of FIG. 2 and in the direction indicated generally when the packaging structure is in the unloaded position.
Figure 5:
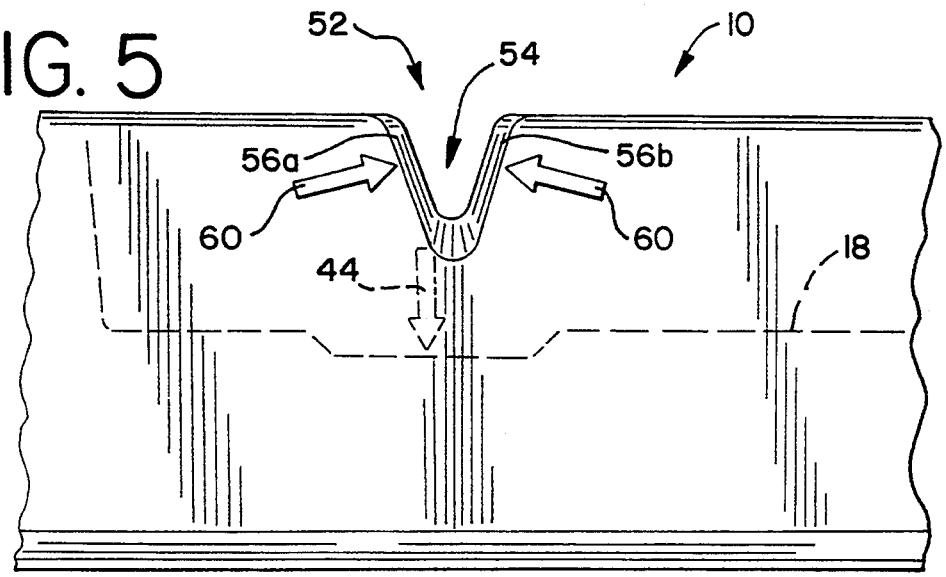
FIG. 5 illustrates a view taken along the line 5—5 of FIG. 2 and in the direction indicated generally with the corner of the embodiment of FIG. 2 being as shown by the dashed line in that figure when the packaging structure of the invention is loaded with a fragile article.
Figure 6:
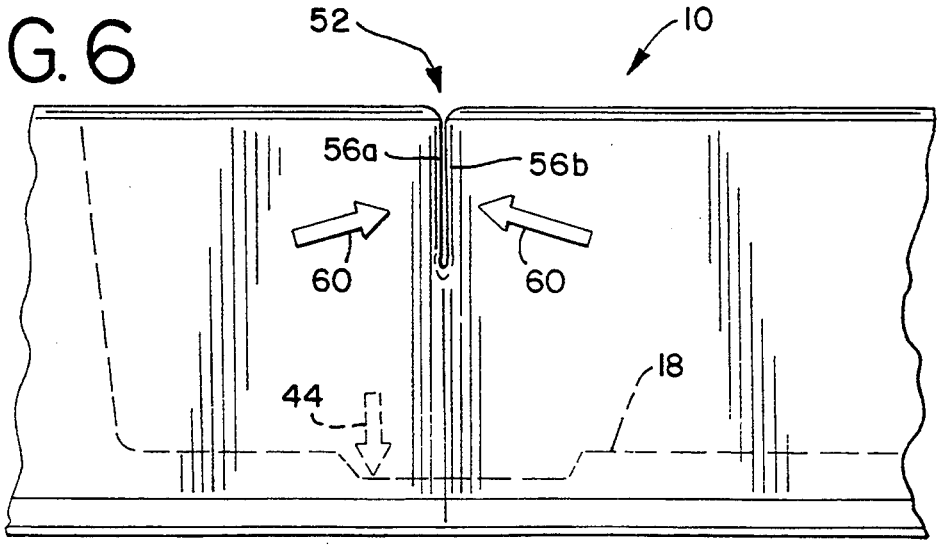
FIG. 6 illustrates a view taken along the line 6—6 of FIG. 2 and in the direction indicated generally when the packaging structure of the invention receives a shock or impact load.

Referring now to FIGS. 4–6, it will be noted that when a force, as represented by the arrow 44, is exerted upon the platform 18, aside from the flexing of the inner and outer walls, 32, 38, and the bridge section 26, there is a peripheral compression of the sidewall structure 22 around the enclosure 24. This compression causes the inner edge 28 to tightly engage the packaged article 12, and also causes exceptional stresses at an least one corner 52, where corresponding wall segments of the sidewall structure 22 meet. With a unitary packaging structure 110 having the particular configuration of the corner 52 as shown in FIG. 3, this compression force can become strong enough to crinkle and/or damage the structural integrity of the unitary packaging structure 110 at the corner 52.

In order to more readily dissipate forces of the nature represented by the arrow 44, it is preferable that certain geometry be provided to the packaging structure 10, 110. Specifically, a shock limiting device 54 is provided for absorbing the vertical compression experienced by the platform 18 when a vertical shock force is suffered. The shock limiting device 54 is preferably configured as a V-shaped indentation which is formed in the sidewall structure 22, and is integral with the bridge 26, the shorter wall 32 and the longer wall 38. The indentation 54 extends from the bridge 26 into the shorter wall 32 and into the longer wall 38, and has end faces 56*a*, 56*b*.

As part of the corner 52, each indentation 54 defines the adjacent portions of the sidewall structure 22 into wall segments. The indentations 54 are configured and positioned on the sidewall structure 22 to compress upon the exertion of the generally vertically directed forces generated by shock impacts upon the container 14 which cause the platform portion 18 to move into the cushion distance 58. In the preferred embodiment, in order to provide protection against laterally directed shock impacts, the horizontal distance 59 (best seen in FIG. 2A) between the peripheral edge of the platform portion 18 and the outer peripheral edge 50 of the foot 46 is approximately equal to the cushion distance 58. Thus, the sidewall structure 22 is configured to accommodate an amount of lateral compression which is approximately equal to said cushion distance.

Referring now to FIG. 4, the packaging structure 10 of the invention is shown in the unloaded position, with the platform portion 18 at its uppermost location, and each of the shock limiting indentations 54 at their most splayed position. This is the configuration of the packaging structure 10 prior to the placement of the fragile article 12 therein.

Referring now to FIG. 5, the packaging structure 10 is shown in the position after a fragile article 12 has been inserted for shipment. It will be evident that the platform portion 18 has become slightly lowered due to vertical loading, represented by the arrow 44, which also causes some peripheral compression as described above, and which is represented here as the arrows 60. In order to compensate for, and absorb this peripheral compression, and to prevent deformation of the corners 52, the indentation 54 closes slightly so that the end faces **56*a*, 56*b* are located closer together. An additional effect of the placement of the article 12 upon the packaging structure 10 is that the outer wall 38 will bow outward slightly as shown at 38*a* and may even contact a wall of the container 14 (best seen in FIG. 1). Thus, the overall height of the packaging structure 10, 110** is reduced slightly.

Referring now to FIG. 6, the packaging structure 10 is shown in the maximum shock absorbing position, which will occur upon the application of a shock force to the container 14 and the transmission of that force to the fragile article 12. The impact, which is of the occurring upon the dropping of the container 14, will cause sufficient g-forces to cause maximum vertical lowering of the platform portion 18 to virtually the full extent of the cushion distance 58. In this position, it is evident that the end faces **56*a*, 56*b* will assume a contacting relationship with each other through the application of the compression forces 60**.

Another important function of the shock limiting device 54 is to serve as a stop which limits the downward travel of the platform portion 18. FIG. 6 illustrates that as the platform portion 18 reaches the full limit of the cushion distance 58, the end faces **56*a*, 56*b* come into contact with each other. Through this closing of the end faces, the indentation 54 limits the compression forces 60 to reduce further vertical movement of the platform portion 18 towards the lower end 42 of the longer wall 38. Additional structural and operational details of the package 10, 110** are disclosed in commonly assigned U.S. Pat. No. 5,226,543, which is incorporated by reference herein.

It has been found that when the packaged fragile article 12 is relatively light, upon shock loading, the package 10 may not deform or flex to compress sufficiently to prevent shock damage to the article. To increase the flexibility of the package 10, in the present invention, at least one control device is provided for selectively releasing air compressed beneath the package when the package is subjected to shock loading while disposed in the shipping container 14. Preferably, the control device takes the form of at least one collapsibility opening 62 located in at least one of the platform 18 and the sidewall structure 22.

One preferred location for the collapsibility opening 62 is in the vicinity of the outer periphery of the shock limiting device 54 located on the corners 52. These collapsibility openings are designated **62*a*. An alternate location for the collapsibility openings 62 is to remove a central portion of the platform portion 18, which defines a collapsibility opening 62b (best seen in FIG. 3). Yet another location for the collapsibility openings 62 is the inner wall 32 and the outer wall 38 of the sidewall structure 22, those collapsibility openings being designated 62*c* and 62*d*, respectively. In fact, the collapsibility openings 62 may be located on any surface of the package 10**.

For ease of tooling, the collapsibility openings 62 may preferably be circular, however other shapes are contemplated. The size of the collapsibility openings 62 may also vary with the application. Further, the specific number of collapsibility openings may be controlled as needed, and is a function of the weight of the packaged article, and the gauge of material used to form the package 10.

It has been found that the collapsibility openings 62 release compressed air trapped between the package 10 and the carton 14 upon shock loading such as occurs during a vertical drop. The addition of the collapsibility openings 62 has resulted in a surprising decrease in g-forces experienced by packaged articles. For a packaged article such as a laptop computer weighing approximately 6 lbs., when packaged in a package 10 not equipped with collapsibility openings 62 and placed in a carton, a conventional drop test resulted in a reading of approximately 80 to 100 "g"s. However, when the same package was equipped with collapsibility openings 62, the forces decreased to approximately 30 to 40 "g"s. For purposes of comparison, if the packaged article is dropped without any protection, readings of 200 to 400 "g"s are not uncommon.

Figure 7:
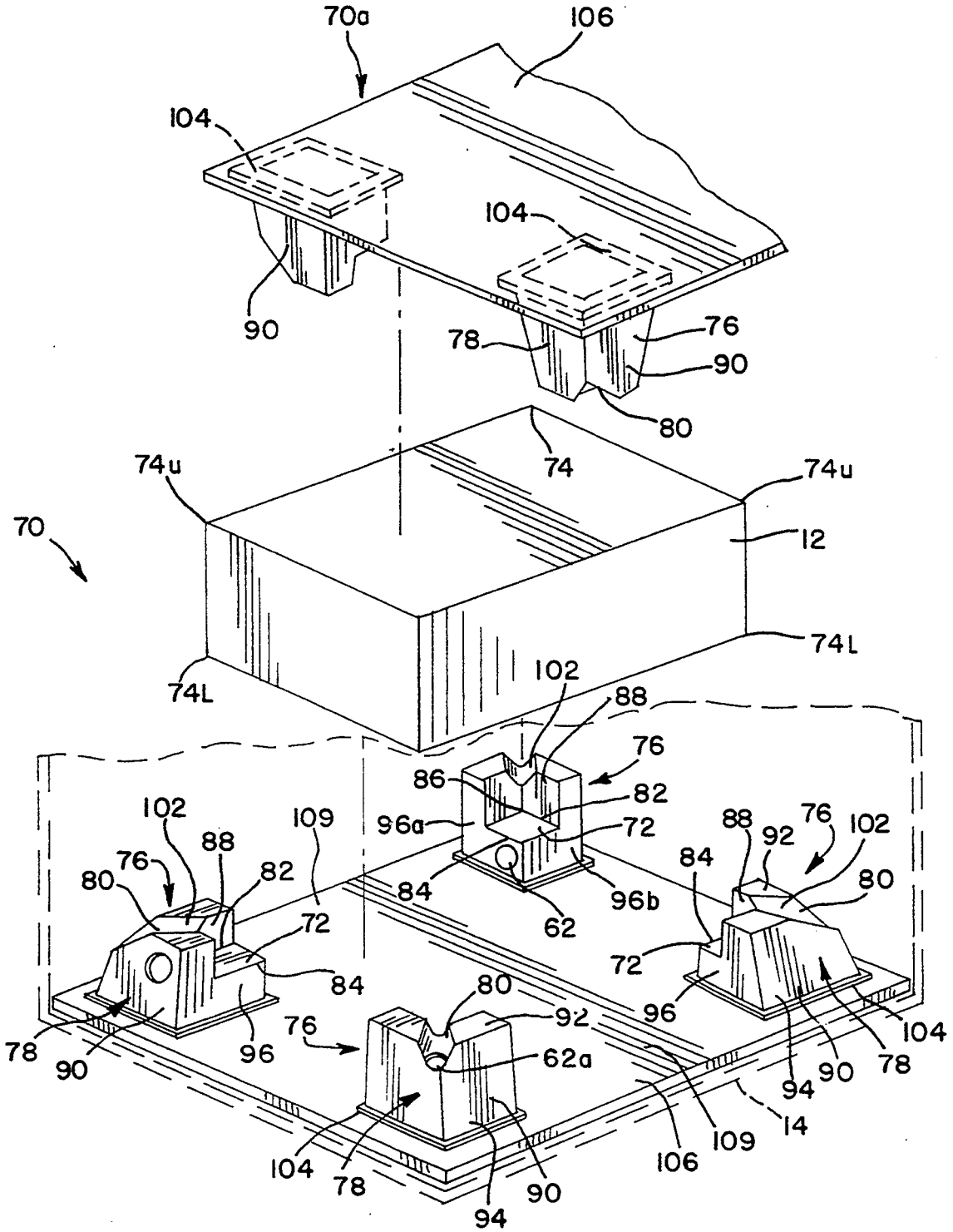
FIG. 7 is an exploded perspective elevational view of another embodiment of the present package.

Referring now to FIG. 7, another embodiment of the present package is indicated and is generally designated 70. Generally speaking, the package 70 is similar to the package in that it provides a suspended, fragile-article-bearing platform held above a base by a structure having controlled collapsibility. However, in the package 70, the structure formerly designated the platform portion 18 has been substantially reduced in size, so that the article 12 is suspended within the carton 14 (shown partially and in phantom) by a plurality of distinct platform segments 72, one located at each of the corners 74 of the article. The platform segments 72 are illustrated as being disposed at the lower corners 74L of the article 12. A second structure **70*a* having a second plurality of segments 72 (not shown) may preferably be disposed at the upper corners 74U as well. The packaging structure 70*a* will normally be identical to the structure 70, however, this relationship is a factor of the shape of the article 12. The article 12** is shown in FIG. 7 as having a box-like shape which is intended to represent the variety of packaged articles described previously.

Each platform segment 72 is preferably an integral part of a package structure 76, also referred to as a support block. In addition to the platform segment 72, the support blocks 76 are similar to corner portions or segments of the package structure 10, and each include a sidewall structure 78, and also preferably include a shock limiting formation 80.

The sidewall structure 78 forms an enclosure about a first edge 82 of the corresponding platform segment 72. A second edge 84 of the platform segment 74 is generally opposite the first edge 82. In the embodiment of FIG. 7, each of the first and second edges includes an angle 86; however, other configurations are contemplated. In the illustrated embodiment, the angle 86 is approximately 90°, although other angles are contemplated, depending on the application.

Included in the sidewall structure 78 is an inner wall 88 which is preferably integral with the platform segment 72. An outer wall 90 is maintained in spaced, generally parallel relationship with the inner wall 88 by a bridge section 92. As is indicated in FIG. 7, when the first edge 82 of the platform segment 74 includes an angle, which is preferably for supporting the corners 74 of the article 12, both the inner and outer walls 88, 90 also form a corresponding angle.

Ideally, each of the support blocks 76 is manufactured from a single sheet of thermoformable material, which results in a hollow, unitary package wherein all of the portions are integrally joined. A preferred material is high density polyethylene (HDPE), either virgin or recycled. However, as is the case with the package 10, the use of other similar thermoformable materials known to skilled thermoformers is contemplated. Injection molding is also contemplated. The inner wall 88 is relatively shorter than the outer wall 90 so that each platform segment 72 is held the specified cushion distance 58 above a lower edge 94 of the outer wall.

To support the second side 84 of each of the platform segments 72, each support block 76 also includes a depending support skirt 96. Preferably, the skirt 96 is integral with the platform segment 12 and includes a lower edge which is substantially coplanar with the lower edge 94 of the outer wall 90. The prime function of the skirt 96 is to support the second side 84 of the platform segment 72 when the article 12 is placed thereupon. At the same time, the skirt 96 should preferably allow controlled collapsibility upon vertical shock loading similar to that provided by the package 10. The degree of support provided by the skirt 96 varies with the gauge of material as well as the connection of the skirt to the other portions of the support block 76.

One of the stronger connections is shown in FIG. 7, in which the depending skirt 96 forms an approximate 90°angle, as seen from above, to conform to the second side 84 of the platform segment 72. Further, this angular configuration divides the skirt 96 into two portions, **96*a* and 96*b*, each of which is basically 'L'-shaped as viewed from the side to form an integral connection with the sidewall structure 78. If desired, additional collapsibility may be provided by adding collapsibility openings 62 as discussed in relation to the package structure 10. Furthermore, the number and placement of the openings 62 may vary, among other things, with the gauge of material, the weight of the article 12 and the size of the support block 76** in relation to the article.

As was the case with the package structure 10, shock limiting devices or formations 80 may be provided to each support block 76 as desired. Preferably, the shock limiting device 80 is provided as a generally 'V'-shaped indentation in the sidewall structure 78, and is integral with the bridge section 92, the shorter inner wall 88, and the longer outer wall 90. The indentation 80 extends from the inner wall 88 to the outer wall 90 and has two faces 102. As is the case with the shock limiting device 54, the specific configuration of these devices may vary depending on the application, and may not always be 'V'-shaped.

Forming the corner of the sidewall structure 78, each indentation 80 defines the adjacent portions of the sidewall structures into wall segments. The indentations 80 are configured and positioned on the sidewall structure 78 to compress upon the exertion of generally vertically directed shock forces which cause the platform segment 72 to move into the cushion distance 58. In similar fashion to the packaging structure 10, upon maximum loading, the faces **102*a*, 102*b* will come into contact with each other to prevent the "bottoming" the platform segment 72 at the full limit of the cushion distance 58**. This action is substantially the same as described previously in relation to FIGS. 4–6.

Referring again to FIG. 7, a preferred mounting arrangement of the support blocks 76 is illustrated. Each block 76 is provided with a radially extending lip or flange 104 which is preferably located along the lower edges 94, 98 of both the outer wall 90 and the skirt 96, respectively. This flange 104 forms the attachment point for each of the support blocks 76 upon a substrate 106. The substrate 106 may be a die-cut piece of corrugated cardboard, as shown, or may be the bottom or top the shipping container 14. Each block 76 is preferably affixed to the substrate 106 by pressure sensitive adhesive or other equivalent adhesive. The location of each block 76 will generally correspond with the position of a respective corner 74 of the article 12. A major advantage of the structure 70 compared to the structure 10, regardless of whether the collapsibility openings 62 are provided or not, is that the structure 70 reflects an approximate 60% reduction in required thermoformable material from a structure 10 of comparable size and gauge. At the same time, comparable shock absorption characteristics are provided.

Figure 8:
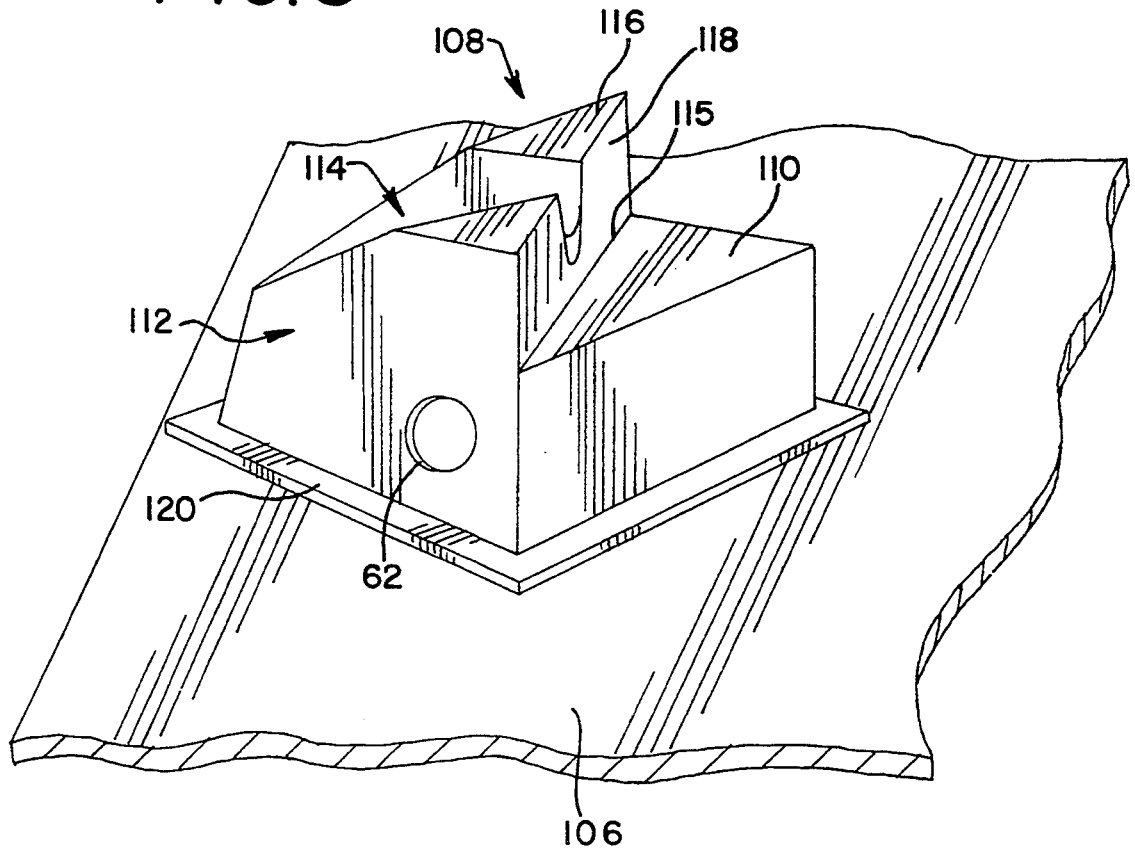
FIG. 8 is a perspective elevational view of a packaging structure to be used with the embodiment of FIG. 7.

Referring now to FIG. 8, for applications where the structure 70 is desired, and the packaged fragile article 12 is especially long or heavy, one or more additional package structures, or support blocks, designated 108 may be provided. The structure 108 may preferably be affixed to the substrate between adjacent "corner-type" support blocks 76 at points 109 (best seen in FIG. 7), or wherever additional support is needed to non-corner edge portions of the article 12. Affixation is accomplished in the same manner as is each block 76.

In structure, the structure 108 is similar to the structure 76, in that it includes a platform segment 110, a sidewall structure 112 and a shock limiting formation 114, all of which are similar in appearance to the corresponding structures on the support blocks 76. The major difference is that since the structure 108 is not located at the corner 74 of the article 12, but mid-length along the edge thereof, a first edge 115 of the platform segment 110 will form a generally straight line instead of an angle. Accordingly, a bridge section 116 and an inner wall 118 reflect this straight line appearance. The bridge section 116 is generally triangular in plan view, as opposed to diamond shape of the bridge section 92. Similarly, the inner wall 118 is generally straight, in plan view, as compared to the 'L'-shaped or corner appearance of the wall 88. A radially extending flange 120 corresponds in structure and function to the flange 104. In other respects, the package structure 108 in its preferred embodiment, is virtually identical to the structure 70.

In operation, the package of the invention 10,110, 70, is placed in the bottom **14*a* of the carton 14, and the fragile article 12 is positioned within the enclosure 24. This initial loading will cause the platform 18, or the platform segments 72, to depress slightly, as depicted in FIG. 5. Upon this depression, the sidewall structure 22 will compress around the periphery of the article 12, thus gripping it tightly in the region of the inner bridge edge 28. In applications where the fragile article 12** merits additional protection, additional structures 10*a* or 70*a* may be placed on the top or around the sides of the article 12 between the article and the container wall. The packaging structure 70 is contemplated for use where economy of packaging is critical, and provides equivalent shock protection to the package structure 10.

Should the carton 14 be dropped or suffer some shock impact which exerts a force on the packaged article 12, the platform portion 18 or the platform segments 72 will move into the cushion distance 58, causing a longitudinal compression about the enclosure 24, or its equivalent zone in the structure 70. The downward movement of the platform portion 18, and the compression of the sidewall structure 22, 78, will be stopped once the adjacent faces 56*a*, 56*b* or 102*a*, 102*b* of the respective shock limiting indentations 54, 80 come into contacting relationship with each other. This downward movement will preferably be within the maximum cushion distance 58. Once the shock impact has passed, the package 10, 70, will resume its original loaded position, and will be capable of absorbing repeated shock impacts without suffering a deterioration of shock absorbing capacity.

In addition, the provision of collapsibility openings 62 as needed, will tend to further enhance the collapsibility of the package when lighter weight articles 12 are packaged. When the package 10, 70 having openings 62 is employed, upon the exposure of the carton 14 to a shock, air compressed by the downward vertical movement of the platform 18 or the platform segments 72 against the interior of the package 10, and each structure 76 will force the air out through the openings 62. This process will facilitate the downward movement of the platform 18 or the segments 72 into the cushion distance 58 against any unwanted inherent rigidity of the package 10, or the structures 70 which might itself otherwise cause a shock to the article 12.

INDUSTRIAL APPLICABILITY

The present invention provides a unitary packaging structure 10, 70, which is useful for providing cushioning for a shock sensitive article 12. Advantages of the present packaging structure 10, 70 include that it can absorb repeated shocks of as much as 90% of its cushioning distance, that it can be made of material which is substantially 100% recyclable, it can be made inexpensively by mass production techniques, and a plurality of the packaging structures 10, or the structures 76 can be readily stacked together in a small space for storage and/or shipment. Furthermore, the package 70 utilizes only a fraction of the thermoformable material of the package 10, while providing comparable shock absorbing characteristics. A significant environmental advantage is provided utilizing such structures as opposed to the prior art rigid polystyrene foams.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

That which is claimed is:

1. A unitary packaging structure for a shock sensitive article, comprising:

a platform portion adapted to support at least a portion of the article and having a peripheral portion;

a sidewall structure forming an enclosure around at least a portion of said platform portion, said sidewall structure including an inner wall being joined to said peripheral portion, and an outer wall peripherally spaced from said inner wall, said inner wall being relatively shorter than said outer wall so that said platform portion is held a specified cushion distance above a lower edge of said outer wall; and at least one collapsibility control means selectively releasing air compressed beneath said package when said package is subjected to shock loading while disposed in a shipping containers said collapsibility control means being located in said sidewall structure.

2. The packaging structure as defined in claim 1 further including shock limiting means formed in said sidewall structure for restricting the movement of said platform portion toward said lower edge of said outer wall upon shock loading of said platform portion.

3. The packaging structure as defined in claim 2 wherein said shock limiting means includes at least one indentation formed in a bridge section connecting said inner and outer walls, said indentation defining said sidewall structure into multiple wall segments having end faces, and upon shock loading of said platform portion, said end faces of adjacent wall segments being configured to contact each other to limit the movement of said platform portion.

4. The packaging structure as defined in claim 3 wherein each said indentation is generally V-shaped and extends from said bridge section into said inner wall and said outer wall.

5. The packaging structure as defined in claim 3 wherein said control means is disposed in at least one of said indentations.

6. The packaging structure as defined in claim 5 wherein said packaging structure includes four of such indentations.

7. The packaging structure as defined in claim 1 wherein said sidewall structure includes a bridge formation maintaining said outer wall and said inner wall in spaced relationship to each other.

8. The packaging structure as defined in claim 1 further including a container having a plurality of walls and a bottom upon which said packaging structure is positioned, said outer wall being configured to contact at least one of said walls of said box.

9: A packaging structure as defined in claim 1 further including a bridge section for joining corresponding upper ends of said inner wall and said outer wall.

10. A unitary packaging structure for a shock sensitive article, comprising:

a platform portion adapted to support at least a portion of the article and having a peripheral portion with a first edge and a second edge;

a sidewall structure forming an enclosure around only said first edge of said platform portion, said sidewall structure including an inner wall being joined to said peripheral portion, and an outer wall peripherally spaced from said inner wall, said inner wall being relatively shorter than said outer wall so that said platform portion is held a specified distance above a lower edge of said outer wall;

shock limiting means formed in said sidewall structure for restricting the movement of said platform portion toward said lower edge of said outer wall upon shock loading of said platform portion; and support means for supporting said second edge of said platform against vertical displacement.

11. The packaging structure as defined in claim 10, wherein said first platform edge forms a corner, and said sidewall structure is angled to correspond to said corner.

12. The packaging structure as defined in claim 10, wherein said first platform edge is generally linear, and said sidewall structure is configured so that said inner wall is coextensive with said first platform edge.

13. The packaging structure as defined in claim 10, wherein said support means includes a skirt depending from said second platform edge and having a bottom edge being generally coplanar with said lower edge of said outer wall.

14. The packaging structure as defined in claim 10, wherein said shock limiting means includes at least one indentation formed in a bridge section connecting said inner and outer walls, said indentation defining said sidewall structure into multiple wall segments having end faces, and upon shock loading of said platform portion, said end faces of adjacent wall segments being configured to contact each other to limit the movement of said platform portion.

15. The packaging structure as defined in claim 10, further including a plurality of said packaging structures configured for spaced disposition about the shock sensitive article, at least one packaging structure of said plurality of packaging structures being configured for disposition at a corner of said article.

16. The packaging structure as defined in claim 15, wherein at least one packaging structure of said plurality of packaging structures is configured for disposition supporting an area of the article located between two corners thereof.

17. The packaging structure as defined in claim 15, further including a substrate to which said plurality of packaging structures may be affixed.

18. The packaging structure as defined in claim 10, further including at least one control means for selectively releasing air compressed beneath said packaging structure when said packaging structure is subjected to shock loading while disposed in a shipping container.

19. The packaging structure as defined in claim 18 wherein said control means includes at least one opening located in at least one of said platform portion and said sidewall structure.

20. A packaging structure for a fragile article, comprising:

at least one support block having a platform portion adapted to support at least a portion of the article and having a peripheral portion with a first edge and a second edge;

a sidewall structure forming an enclosure around only said first edge of said platform portion, said sidewall structure including an inner wall being integral with said peripheral portion, and an outer wall peripherally spaced from said inner wall, said inner wall being relatively shorter than said outer wall so that said platform portion is held a specified distance above a lower edge of said outer wall;

shock limiting means formed in said sidewall structure for restricting the movement of said platform portion toward said lower edge of said outer wall upon shock loading of said platform portion; and a substrate to which said at least one support block is secured for supporting various portions of the fragile article.

21. The packaging structure as defined in claim 20 further including support means for supporting said second edge of said platform portion.

22. The packaging structure as defined in claim 20 wherein said at least one support block includes a first plurality of blocks for supporting corners of the fragile article, and a second plurality of blocks for supporting edge portions of the fragile article.

23. The packaging structure as defined in claim 20 further including at least one collapsibility opening in at least one of said support blocks.

* * * * *

UNITED STATES PATENT AND TRADEMARK OFFICE

CERTIFICATE OF CORRECTION

PATENT NO. : 5,385,232
DATED : January 31, 1995
INVENTOR(S) : Foos et al.

It is certified that error appears in the above-identified patent and that said Letters Patent is hereby corrected as shown below:

On the Face of the Patent:

Under "[73] Assignee:" insert --Roberts, Stephens, Van Amburg Packaging Inc., Soquel, California--

Signed and Sealed this
Ninth Day of May, 2000

*Attest:*

Q. TODD DICKINSON

*Attesting Officer*

*Director of Patents and Trademarks*